US006689217B2

(12) United States Patent
Jarvis et al.

(10) Patent No.: US 6,689,217 B2
(45) Date of Patent: Feb. 10, 2004

(54) APPARATUS FOR CHEMICALLY TREATING A METAL PART

(75) Inventors: Richard A. Jarvis, Troy, MI (US); Eduardo F. Vazquez, Novi, MI (US); Clive Snell, Canton, MI (US); David J. Cole, Canton, MI (US)

(73) Assignee: Dürr Industries, Inc., Plymouth, MI (US)

( * ) Notice: Subject to any disclaimer, the term of this patent is extended or adjusted under 35 U.S.C. 154(b) by 0 days.

(21) Appl. No.: 10/315,567

(22) Filed: Dec. 10, 2002

(65) Prior Publication Data

US 2003/0116179 A1 Jun. 26, 2003

Related U.S. Application Data

(60) Provisional application No. 60/339,622, filed on Dec. 12, 2001.

(51) Int. Cl.[7] ..... B05C 19/02

(52) U.S. Cl. ..... 118/423; 118/304

(58) Field of Search ..... 204/198, 137, 204/273; 118/302, 323, 321, 317, 318, 315, 304, 305, 320, 322, 423, 425, 426; 134/104.1, 172, 170, 123, 167 R, 72, 73, 198

(56) References Cited

U.S. PATENT DOCUMENTS 4,196,023 A * 4/1980 Rowe
4,287,004 A * 9/1981 Murakami et al.
4,399,768 A * 8/1983 Tokushima et al.

* cited by examiner

*Primary Examiner*—Brenda A. Lamb
(74) *Attorney, Agent, or Firm*—Howard & Howard

(57) ABSTRACT

An apparatus for chemically treating a metal part which includes an immersion tank containing a liquid chemical treatment solution, a conveyor conveying parts over the immersion tank, immersing and removing the part and at least one spray nozzle assembly located above the immersion tank which is supported on a track extending to a side wall of the tank and permitting maintenance of the spray nozzle assembly without draining the tank.

9 Claims, 2 Drawing Sheets

APPARATUS FOR CHEMICALLY TREATING A METAL PART

RELATED APPLICATIONS

This application claims priority to U.S. Provisional Patent Application Ser. No. 60/339,622 filed Dec. 12, 2001.

FIELD OF THE INVENTION

This invention relates to an apparatus for chemically treating a metal part including but not limited to phosphate and other conversion coatings which are applied to the metal part by immersion in a tank including pretreatment systems for preparing a metal part such as an automotive body for paint application.

BACKGROUND OF THE INVENTION

Pretreatment refers to treatment of a metal surface such as an automobile body in preparation for subsequent electrodeposition paint application via an electrocoat tank. A typical vehicle body arrives at a pretreatment apparatus covered with metal-forming oils, grinding dust and other environmental contaminants. Each of these must be removed in order to apply a defect-free phosphate coating. Pretreatment includes a series of surface cleaning stages followed by phosphating, or the application of another conversion coating. Zinc phosphate is the principal conversion coating used in the automobile industry today, although iron phosphate is widely used in other applications. The pretreatment process includes a series of steps designed to remove contaminants from the metal surface, convert the surface to an inorganic crystalline coating, and seal the crystalline structure.

One example of an immersion zinc phosphating system includes nine stages: spray cleaner, immersion cleaner, spray rinse, immersion conditioner rinse, immersion zinc phosphate, immersion rinse, immersion chromic acid rinse, immersion recirculated deionized water rinse, and spray virgin deionized water rinse. The first two stages, the spray cleaner and immersion cleaner stages, clean the surface of contaminants to prepare the surface to form a tight, adherent, fine-grained zinc phosphate coating. Absent a clean surface, the first layer of paint, commonly referred to as an electrodeposition coating, will not adhere properly resulting in paint defects projecting through the topcoat or premature corrosion. The third stage, the spray rinse stage, follows cleaning and rinses the cleaning solution from the metal surface. Failure to rinse the cleaning solution results in contamination of subsequent chemical treatment stages. The immersion conditioner rinse stage, stage four, increases nucleation sites on the metal surface, thereby reducing the amount of zinc phosphate required to coat the surface and improving conversion coating uniformity. The immersion zinc phosphate stage, stage five, applies phosphate crystals to the metal surface, giving the surface corrosion-inhibiting properties and providing an improved base for paint application. Stage six, the immersion rinse, rids the surface of by-products from the zinc phosphate stage that could contaminate stage seven, the immersion chromic acid rinse. The chromic acid rinse removes remaining water soluble compounds from the surface to maximize corrosion protection. While the chromic acid rinse stage is not essential to the phosphating process, corrosion resistance of many substrates has proven to be greatly enhanced by the use of chromic acid. The last two stages, the recirculated deionized water rinse and the spray virgin deionized water rinse, remove all phosphate residue from the surface so as not to contaminate the electrocoat tank.

Each of the six immersion stages and the subsequent electrocoat process uses a tank having, for example, an 80,000 gallon capacity containing the various solutions required to complete the pretreatment process. As the metal surface enters and leaves each solution, spray nozzles positioned at an inlet and an outlet location above the immersion tank deluge the surface with the immersion solution. These spray nozzles frequently become clogged throughout the process. In the cleaning stages, contaminants from the metal surface, such as free carbon remaining on the surface from production grinding, clog the nozzles. In subsequent stages, the phosphating process causes chemical reactions creating by-products which clog the nozzles. For example, the immersion zinc phosphate stage creates an excess of iron phosphate, a white powdery substance coats the spray nozzles at the inlet and the outlet of the stage impeding the spray pattern needed to produce a satisfactory phosphate coating. Preferably, the spray nozzles are located above the immersion tanks just prior to the location where the vehicle bodies enter or leave the tank. To clean these spray nozzles, the immersion tank must be drained and scaffolding constructed above the tank to provide access to the nozzles, which is costly and time consuming.

It is therefore an object of the present invention to provide a spray nozzle apparatus which may be cleaned in a more efficient and less costly manner so that the time required to clean the nozzles can be reduced.

SUMMARY OF THE INVENTION

As set forth above, this invention relates to an apparatus for chemically treating a metal part particularly including phosphate or other conversion coatings via a pretreatment system including an immersion tank. The immersion tank contains a liquid chemical treatment solution including, but not limited to spray cleaner, immersion cleaner, spray rinse, immersion conditioner rinse, immersion zinc phosphate, immersion rinse, immersion chromic acid rinse, immersion recirculated deionized water rinse and spray virgin deionized water rinse as set forth above. The apparatus includes a conveyor conveying a metal part to be treated, such as an automotive body, from a first position above the immersion tank, then immersing the metal part in the liquid chemical treatment solution, and then removing the metal part from the immersion tank to a second position above the immersion tank. As will be understood, the first and second positions are generally adjacent opposed ends or end walls of the immersion tank, but the first and second positions may also be the same position or nearly the same, wherein the conveyor moves the metal part above the immersion tank, lowers the metal part into the liquid chemical treatment solution, raises the metal part and conveys the metal part away from the immersion tank.

The apparatus for chemically treating a metal part further includes at least one spray nozzle assembly located above the immersion tank which includes a plurality of spray nozzles spraying the metal part with the chemical treatment solution contained within the immersion tank. As set forth above, the spray nozzles frequently become clogged throughout the process requiring immediate or routine maintenance. In the apparatus for chemically treating a metal part of this invention, however, the spray nozzle assembly is supported on a track extending to at least a side wall of the immersion tank and is movable on the track to the side wall for periodic maintenance. In a preferred embodiment, the track extends beyond the adjacent side wall for maintenance outside the perimeter of the immersion tank. The spray nozzle assembly is conventionally connected to a header which may be located in the immersion tank, for example, or the header may be connected to a separate source of liquid chemical treatment solution. However, because the liquid chemical treatment solution drains from the part into the immersion tank, the liquid chemical treatment solution must generally be the same as the liquid chemical treatment solution in the immersion tank. Further, because the chemical treatment solution may attack or clog a conventional ferrous metal pipe, the pipes are generally stainless steel. Thus, provision must be made for disconnecting the lines from the header to the spray nozzle assembly. In the disclosed embodiment of the invention, the spray nozzle assembly is removably coupled to the header by conventional couplings. However, quick connect couplings may also be utilized or the spray nozzle assembly may be connected to the header by flexible hoses where the application permits.

In a preferred embodiment of the apparatus for chemically treating a metal part of this invention, the apparatus includes at least two spray nozzle assemblies including a first nozzle assembly located above the tank adjacent the first or inlet position of the part including a plurality of spray nozzles spraying the liquid chemical treatment solution onto the metal part prior to immersion of the part in the immersion tank including a first track extending to the first adjacent side of the immersion tank and movable on the first track to at least adjacent the first side of the tank and a second spray nozzle assembly located above the tank adjacent the second or outlet position also including a plurality of spray nozzles spraying liquid chemical treatment solution on the metal part in the second position supported on a second track extending to a second side wall of the immersion tank and movable to the second side wall for maintenance. In the disclosed embodiment, each of the first and second spray nozzle assemblies include an overhead spray assembly having a plurality of spray nozzles spraying the chemical treatment solution downwardly over the metal part and a side spray nozzle assembly or assemblies including a plurality of spray nozzles spraying the liquid chemical treatment solution laterally onto the part, and wherein each of the upper and side spray nozzle assemblies are independently supported on a track and movable to a side wall of the immersion tank as described above.

Thus, the apparatus for chemically treating a metal part of this invention significantly reduces the maintenance required for a treatment apparatus of this type disclosed including draining of the immersion tank for maintenance of the spray nozzle assemblies thereby significantly reducing the maintenance cost. Other advantages and meritorious features of the apparatus of this invention will be more fully understood from the following description of the preferred embodiments, the appended claims and the drawings, a brief description of which follows.

DETAILED DESCRIPTION OF THE PREFERRED EMBODIMENT

Figure 1:
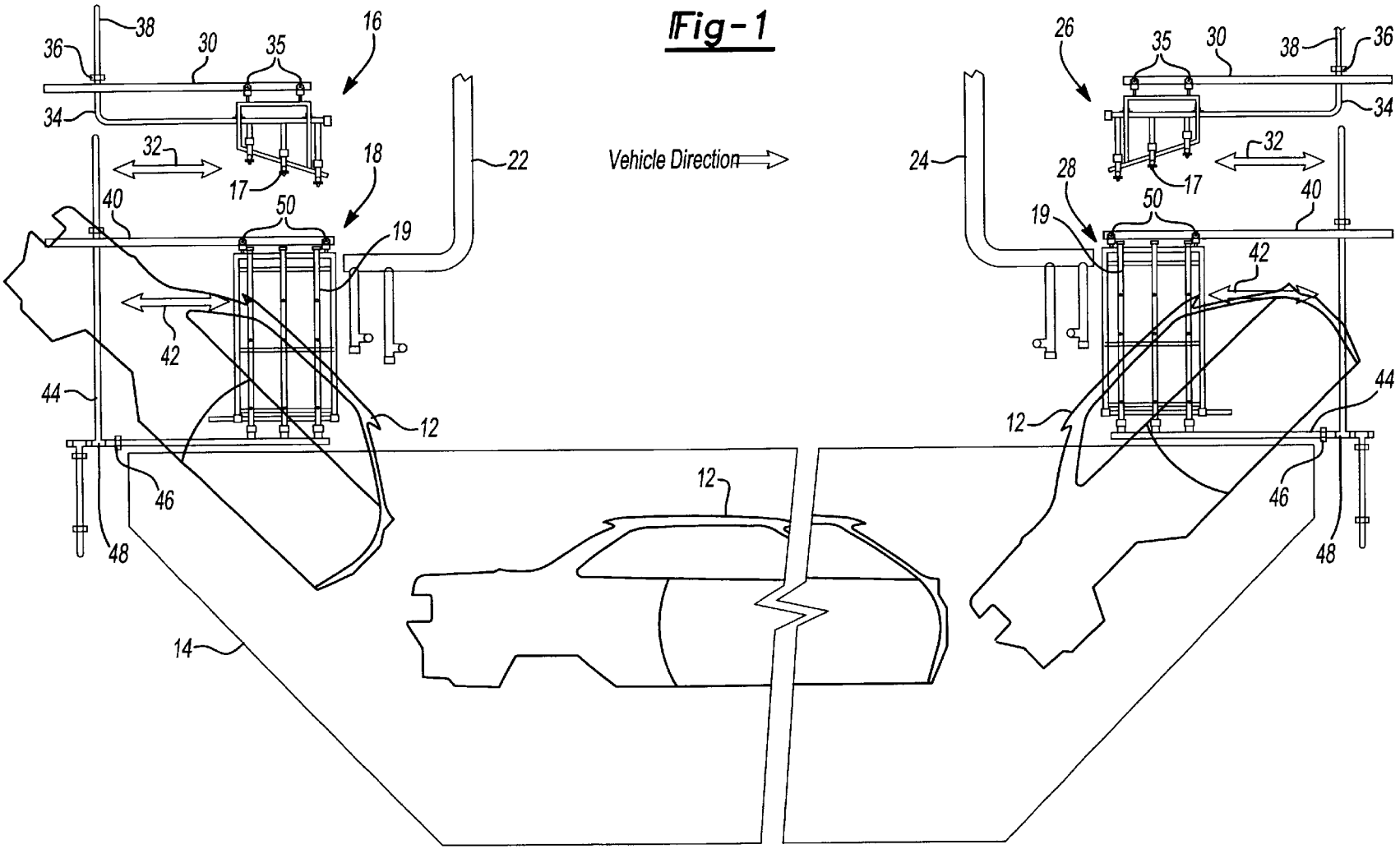
FIG. 1 is a partially schematic side view of a typical immersion tank used during a phosphating or electrocoat process showing movable risers in accordance with the subject invention.
Figure 2:
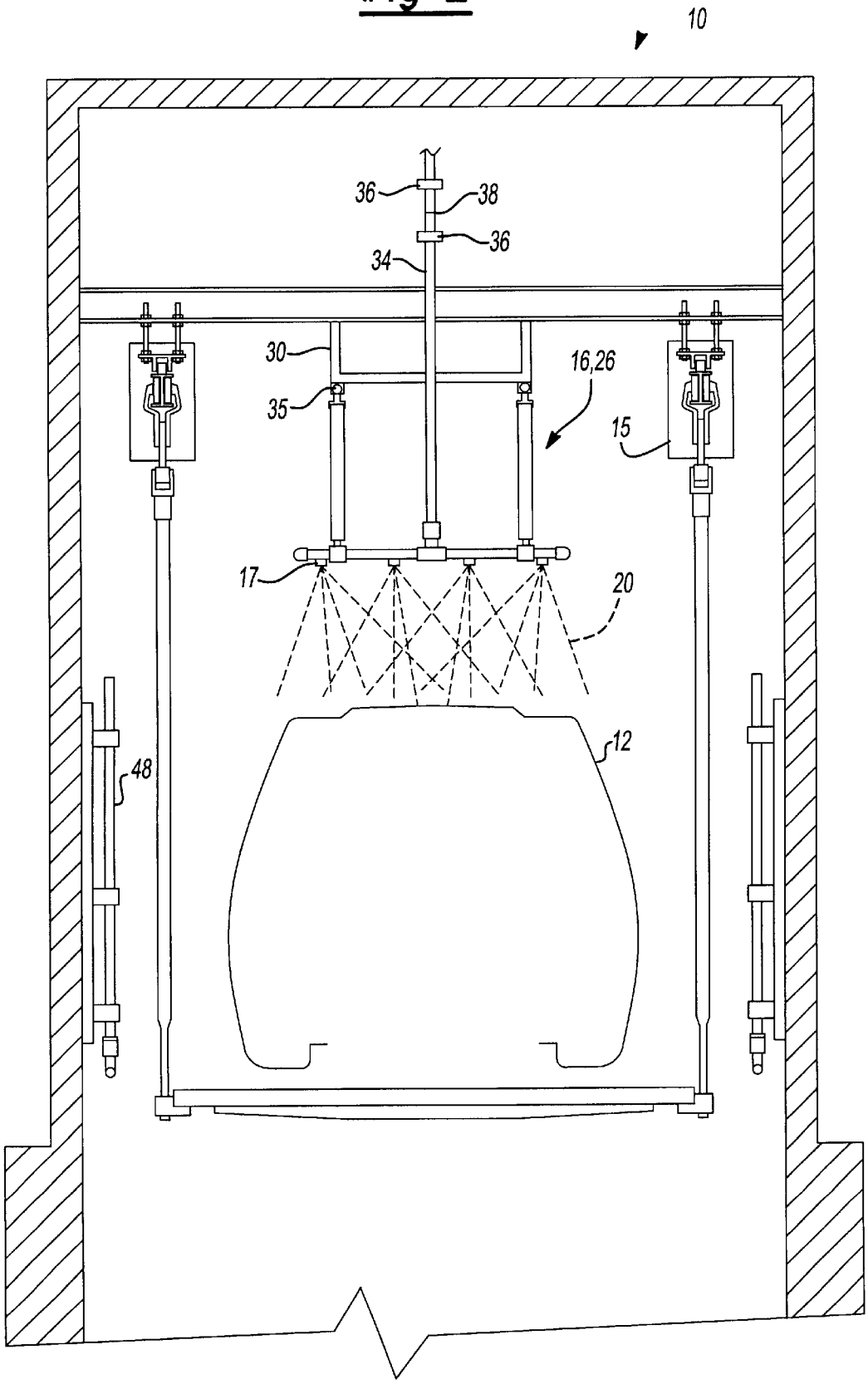
FIG. 2 shows a cross-sectional view along the length of the inventive pretreatment booth.

Referring to the drawings, FIG. 1 shows an immersion stage of a phosphating or an electrocoating process generally at 10. A metal substrate 12, shown here as a vehicle body, moves into a tank 14 via a pendulum conveyor system 15 (FIG. 2). An overhead inlet nozzle assembly shown generally at 16 having overhead spray nozzles 17 and a side inlet nozzle riser shown generally at 18 having side spray nozzles 19 spray the vehicle with water, cleaning solution, phosphate solution, DI water, or permeate 20 as needed by the particular immersion process. In a cleaning immersion process, a first deluge pipe 22 fills the interior of the vehicle body with the cleaning solution 20 as the metal substrate 12 enters the tank 14. As the metal substrate 12 exits the tank 14, a second deluge pipe 24 again floods the interior of the body 12 with the solution 20. An overhead outlet nozzle assembly shown generally at 26 having overhead spray nozzles 17 and a side outlet nozzle riser shown generally at 28 having side spray nozzles 19 further spray the solution 20 as the metal substrate 12 leaves the immersion stage prior to entering a drip zone (not shown) of the phosphating or electrocoating process. The overhead nozzle assemblies 16, 26 are shown in cross-section in FIG. 2.

Each overhead nozzle assembly 16, 26 is movably suspended on an overhead track 30. The overhead track 30 allows movement of the overhead nozzle assembly 16, 26 in the direction indicated by arrow 32. A feed line 34 connects the overhead nozzle assembly 16, 26 to an overhead spray header 38. Preferably, the coupling 36 comprises a victaulic coupling. However, the coupling 36 can comprise a removable coupling as known to those of skill in the art of spray assemblies. A first coupling 36 connects the feed line 34 to the overhead spray header 38. To facilitate cleaning of the overhead nozzle assembly 16, 26, the feed line 34 and the overhead spray header 38 uncouple at the first coupling 36. The overhead nozzle assembly 16, 26 and the overhead header 38 ride along the overhead track 30 upon wheels 35, enabling the overhead nozzle assembly 16, 26 to be moved away from the tank 14 providing access to the overhead nozzle assembly 16, 26 in the drip zone without having to drain the tank 14.

Similarly, each side nozzle riser assembly 18, 28 is movably suspended along a side track 40. The side track 40 allows movement of the side nozzle riser assembly 18, 28 in the direction indicated by arrow 42. An inlet line 44 connects the side nozzle riser assembly 18, 28 to a side spray header 48. A second coupling 46 connects the inlet line 44 to the side header 48. The second coupling may also take the form of a victaulic coupling or functional equivalent. When the nozzles require maintenance or cleaning, the inlet line 44 is disconnected from the side header 48 releasing the side nozzle riser assembly 18, 28 from the side header 48. Once released, the side nozzle riser assembly 18, 28 is slid along the side track 40 upon wheels 50 away from the tank 14 providing access to the side nozzle riser assembly 18, 28 in the drip zone without having to drain the tank.

As will be understood, the apparatus for chemical treatment of a metal part of this invention may be utilized for treatment or pretreatment of various metal parts which are conveyed above an immersion tank and immersed in a liquid chemical treatment solution as described above. However, the apparatus of this invention has particular advantages for pretreatment and electrocoat processes such as used by the automotive industry in mass production applications. In the disclosed embodiment, the apparatus generally includes side outlet risers 18 and 28 on opposed sides of the metal parts to be treated such that the metal part is sprayed from opposed sides as it is received in and removed from the immersion tank 14. Thus, a conventional treatment application actually includes two overhead spray nozzle assemblies, including an inlet nozzle assembly 16 and an outlet nozzle assembly 26, and four side spray nozzle assemblies each supported on a track and movable from above the immersion tank 19 adjacent the inlet and outlet as described above. As will be understood by those skilled in the art, if only one of the six spray nozzle assemblies becomes clogged, the entire system must be shut down for maintenance generally requiring complete draining of the immersion tank which may contain 80,000 gallons of liquid chemical treatment solution, thus requiring shut down of the line for at least one shift and maybe longer. The apparatus for chemically treating a metal part of this invention, however, permits quick maintenance by moving one or more of the spray nozzle assemblies preferably to a location outside of the immersion tank either for periodic maintenance or to clear a clog of one or more of the spray nozzle assemblies. Further, although the disclosed apparatus includes both overhead and side spray nozzle assemblies, an inlet and outlet spray nozzle assembly may be utilized for a particular application which does not require spraying the internal surfaces of a vehicle body as disclosed.

The invention has been described in an illustrative manner, and it is to be understood that the terminology which has been used is intended to be in the nature of words of description rather than of limitation. Obviously, many modifications and variations of the present invention are possible in light of the above teachings.

What is claimed is:

1. An apparatus for chemically treating a metal part, comprising:

an immersion tank containing a liquid chemical treatment solution;

a conveyor conveying a metal part from a first position above said immersion tank, then immersing said metal part in said chemical treatment solution, and then removing said metal part from said immersion tank to a second position above said immersion tank; and at least one spray nozzle assembly located above said immersion tank including a plurality of spray nozzles spraying said chemical treatment solution onto said metal part, wherein said spray nozzle assembly is supported on a track extending to a side wall of said tank and said spray nozzle assembly movable on said track to said side wall of said immersion tank for maintenance.

2. The apparatus for chemically treating a metal part as defined in claim 1, wherein said track extends beyond on said side wall of said tank and said spray nozzle assembly is movable on said track to a position located outside a perimeter of said immersion tank for maintenance.

3. The apparatus for chemically treating a metal part as defined in claim 1, wherein said apparatus includes at least two spray nozzle assemblies, including a first spray nozzle assembly adjacent said first position of said conveyor and a second spray nozzle assembly adjacent said second position of said conveyor above said tank, and each of said first and second spray nozzle assemblies are supported on a separate track and movable to a side wall of said immersion tank.

4. The apparatus for chemically treating a metal part as defined in claim 3, wherein each of said first and second spray nozzle assemblies includes an overhead spray nozzle assembly having a plurality of spray nozzles spraying said chemical treatment solution downwardly over said metal part and a side spray nozzle assembly including a plurality of spray nozzles spraying said chemical treatment solution laterally on said metal part, wherein each of said overhead spray nozzle assemblies and said side spray nozzle assemblies are supported on a separate track and movable to a side wall of said immersion tank for maintenance.

5. The apparatus for chemically treating a metal part as defined in claim 1, wherein said spray nozzle assembly is removably coupled to a header and said header is connected to a source of said liquid chemical treatment solution.

6. An apparatus for chemically treating a metal part, comprising:

an immersion tank containing a liquid chemical treatment solution;

a conveyor conveying a metal part from a first position above said immersion tank adjacent a first side wall of said immersion tank, then immersing said metal part in said liquid chemical treatment solution, and then removing said metal part from said immersion tank to a second position above said immersion tank adjacent a second side wall of said immersion tank; and at least two spray nozzle assemblies including a first spray nozzle assembly located above said tank adjacent said first position including a plurality of spray nozzles spraying said liquid chemical treatment solution on said metal part in said first position supported on a first track extending to said first side wall of said immersion tank and movable on said first track to said first side wall for maintenance and a second nozzle assembly located above said tank adjacent said second position including a plurality of spray nozzles spraying said liquid chemical treatment solution on said metal part in said second position supported on a second track extending to said second side wall of said immersion tank and movable on said second track to said second side wall for maintenance.

7. The apparatus for chemically treating a metal part as defined in claim 6, wherein said first and second spray nozzle assemblies are each removably coupled to a header and said header is connected to a source of said liquid chemical treatment solution.

8. The apparatus for chemically treating a metal part as defined in claim 6, wherein said first and second tracks extend from adjacent said first and second positions of said parts, respectively, to a position outside a perimeter of said immersion tank.

9. The apparatus for chemically treating a metal part as defined in claim 6, wherein said first and second nozzle assemblies each include an overhead spray assembly including a plurality of spray nozzles spraying said chemical treatment solution downwardly over said metal part and a side spray nozzle assembly including a plurality of nozzles spraying said metal part laterally on said metal part, and wherein each of said overhead spray assemblies and said side spray assemblies are each independently supported on a separate track and movable to a position outside a perimeter of said immersion tank.

* * * * *